US009081348B2

(12) United States Patent
Umezawa

(10) Patent No.: US 9,081,348 B2
(45) Date of Patent: Jul. 14, 2015

(54) IMAGE FORMING APPARATUS AND CONTROL METHOD THEREFOR

(71) Applicants: Kabushiki Kaisha Toshiba, Tokyo (JP); Toshiba Tec Kabushiki Kaisha, Tokyo (JP)

(72) Inventor: Noriyuki Umezawa, Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/149,255

(22) Filed: Jan. 7, 2014

(65) Prior Publication Data

US 2014/0119747 A1 May 1, 2014

Related U.S. Application Data

(63) Continuation of application No. 13/153,354, filed on Jun. 3, 2011, now Pat. No. 8,655,201.

(60) Provisional application No. 61/354,547, filed on Jun. 14, 2010.

(51) Int. Cl.
*G03G 15/08* (2006.01)
*G03G 15/00* (2006.01)

(52) U.S. Cl.
CPC ..... *G03G 15/556* (2013.01); *G03G 15/0863* (2013.01); *G03G 2215/0697* (2013.01)

(58) Field of Classification Search
CPC ..... G03G 15/556; G03G 15/0831; G03G 15/0824; G03G 15/086; G03G 15/0863
USPC ..... 399/27
See application file for complete search history.

(56) References Cited

U.S. PATENT DOCUMENTS

| | | | | |
|---|---|---|---|---|
| 7,196,286 | B2 | 3/2007 | Kishi et al. | |
| 2005/0185973 | A1 * | 8/2005 | Hama et al. | 399/27 |
| 2006/0098995 | A1 * | 5/2006 | Kim et al. | 399/27 |
| 2007/0092273 | A1 * | 4/2007 | Shiroki et al. | 399/27 |
| 2007/0223943 | A1 * | 9/2007 | Wakamatsu | 399/27 |
| 2008/0025734 | A1 | 1/2008 | Kehoe et al. | |
| 2008/0107440 | A1 * | 5/2008 | Tsuzuki | 399/79 |
| 2009/0110440 | A1 | 4/2009 | Homma et al. | |
| 2010/0303482 | A1 | 12/2010 | Fujisawa et al. | |
| 2012/0237238 | A1 * | 9/2012 | Tsugawa et al. | 399/61 |

FOREIGN PATENT DOCUMENTS

| | | |
|---|---|---|
| JP | 2003-029582 | 1/2003 |
| JP | 3990921 | 10/2007 |

* cited by examiner

*Primary Examiner* — Walter L Lindsay, Jr.
*Assistant Examiner* — Frederick Wenderoth
(74) *Attorney, Agent, or Firm* — Patterson & Sheridan, LLP

(57) ABSTRACT

According to one embodiment, an image forming apparatus includes: a toner cartridge which includes a storage section; a toner motor; a toner-motor driving section; a count measuring section configured to measure a driving time of the toner motor and calculate a consumption count value of the toner; an event detecting section configured to detect operation events; a main body counter configured to sequentially update a main body counter value with the consumption count value and stores the main body counter value; a toner counter configured to store a toner counter value in the storage section; a counter comparing section configured to perform counter comparison of the main body counter value and the toner counter value; and an event processing section configured to perform processing for keeping consistency of the main body counter value and the toner counter value on the basis of the counter comparison.

7 Claims, 12 Drawing Sheets

FIG. 7

| STATE | | EVENT | PROCESSING |
|---|---|---|---|
| S1 | | POWER ON | READ PROCESSING<br><br>READ OUT COUNTER VALUES OF TONER COUNTERS AND WRITE COUNTER VALUES IN MAIN BODY COUNTERS |
| S2 | | FRONT COVER CLOSE | |
| S3 | | RETURN FROM SLEEP | |
| S4 | S41 | JOB EXECUTION ( END OF FOLLOW-UP SUPPLY) | WRITE PROCESSING<br><br>COUNT UP MAIN BODY COUNTER VALUES ON THE BASIS OF COUNT MEASUREMENT AND WRITE COUNTER VALUES OF MAIN BODY COUNTERS IN TONER COUNTERS |
| | S42 | JOB EXECUTION (END OF FORCED SUPPLY) | |
| S5 | | END OF REFRESH MODE | |
| S6 | S61 | EMERGENCY STOP ( FRONT COVER OPEN) | |
| | S62 | EMERGENCY STOP (POWER OFF) | |
| S7 | | IDLING | WAIT FOR EVENT |

IMAGE FORMING APPARATUS AND CONTROL METHOD THEREFOR

CROSS-REFERENCE TO RELATED APPLICATION

This application is based upon and claims the benefit from U.S. patent application Ser. No. 13/153,354, filed Jun. 3, 2011 which claims the benefit of U.S. Provisional Application 61/354,547, filed Jun. 14, 2010, the entire contents of which are incorporated herein by reference.

FIELD

Embodiments described herein relate generally to an image forming apparatus and a control method therefor.

BACKGROUND

From the viewpoint of product management and maintenance of printing quality, there is an image forming apparatus that writes maintenance information such as the consumption of a toner in a storage section, such as an IC chip, mounted on an exclusive toner cartridge and performs product management in a toner cartridge unit.

In such an image forming apparatus in which the IC chip is mounted on the toner cartridge, in order to estimate the consumption of a toner, time of use of the toner is measured in a unit of operation time of a toner motor and a value measured by the measurement is written in the IC chip.

Specifically, if the toner motor operates for a predetermined time, a counter value is counted up by one. Every time the counter value is counted up, the counter value stored in an image forming apparatus main body is written on the IC chip side.

Such an operation is likely to affect the life of the IC chip because the number of times of writing in the IC chip increases. Usually, the IC chip includes a nonvolatile memory such as an EEPROM. In the current EEPROM technique, from the viewpoint of guarantee of reliability, a limit of an extremely small number of times of access is provided for the number of times of writing compared with a limit for the number of times of reading.

According to an embodiment, there is provided an image forming apparatus and a control method therefor that can substantially reduce the number of times of writing in an IC chip compared with that in the past and correctly match counter values on a main body side and a toner side each other even if a toner cartridge is replaced in maintenance or the like.

BRIEF DESCRIPTION OF THE DRAWINGS

FIG. 7 is a table of operation events and processing in the embodiment;

DETAILED DESCRIPTION

In general, according to one embodiment, an image forming apparatus includes: a toner cartridge which includes a storage section; a toner motor configured to agitate a toner in the toner cartridge; a toner-motor driving section configured to drive the toner motor; a count measuring section configured to measure a driving time of the toner motor and calculate, using a predetermined count unit time, a consumption count value indicating the consumption of the toner; an event detecting section configured to detect operation events; a main body counter configured to sequentially update a main body counter value with the consumption count value and stores the main body counter value; a toner counter configured to store a toner counter value in the storage section; a counter comparing section configured to perform counter comparison of the main body counter value and the toner counter value; and an event processing section configured to perform, when the operation events are detected, processing for keeping consistency of the main body counter value and the toner counter value on the basis of the counter comparison.

Embodiments are explained below with reference to the drawings. Examples of image forming apparatuses according to the embodiments include a color copying machine that performs color and monochrome printing at high resolution and a multifunction peripheral (MFP) that can perform various kinds of processing such as a function of copying an original document, a function of performing communication with an external apparatus, and a function of a facsimile apparatus for transmission and reception and printing.

First Embodiment

Figure 1:
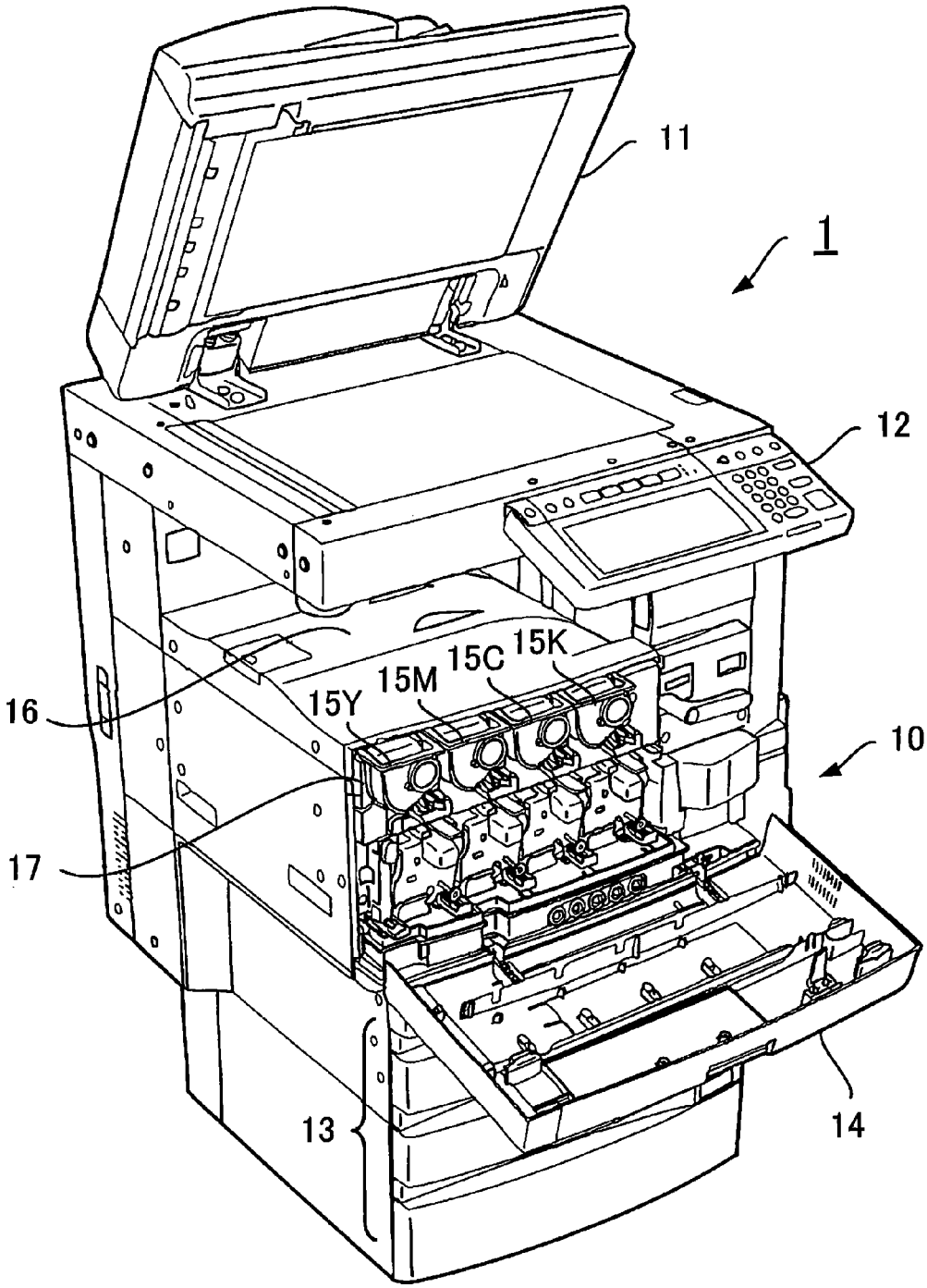
FIG. 1 is a diagram of an apparatus example of an image forming apparatus according to a first embodiment.

A configuration example of an image forming apparatus according to a first embodiment is shown in FIG. 1. In this embodiment, an image forming apparatus that can perform color copying, development, and printing is assumed. This image forming apparatus 1 is a color copying machine of a quadruple tandem system that uses four colors of yellow (Y), magenta (M), cyan (C), and black (K). The image forming apparatus 1 includes a copying machine main body 10, a platen cover 11, a control panel 12, and plural paper feeding cassettes 13.

The copying machine main body 10 assumes a major role concerning image formation. A cover 14 is openably and closably provided in the front of the copying machine main body 10. When the cover 14 is opened, first to fourth toner cartridges 15Y, 15M, 15C, and 15K provided in parallel on the upper side of the copying machine main body 10 are seen. The platen cover 11 is provided pivotably around one side end thereof on the copying machine main body 10. The control panel 12 is an input section for copy operation and a display section configured to display various messages and is provided on the upper surface of the copying machine main body 10. The paper feeding cassettes 13 are cassettes for storing sheets and is detachably provided on the lower side of the copying machine main body 10. A paper discharge unit 16 is provided above the first to fourth toner cartridges 15Y, 15M, 15C, and 15K provided in parallel.

The respective first to fourth toner cartridges 15Y, 15M, 15C, and 15K are provided to be capable of being attached to and detached from a cartridge holding mechanism 17. The first to fourth toner cartridges 15Y, 15M, 15C, and 15K respectively indicate cartridges configured to supply toners of yellow, magenta, cyan, and black. The toner cartridges 15Y, 15M, 15C, and 15K are fit in not-shown toner motors. The toners filled in the toner cartridges 15Y, 15M, 15C, and 15K are supplied to a developing device arranged on the lower side of the toner cartridges while being agitated by the toner motors.

Figure 2:
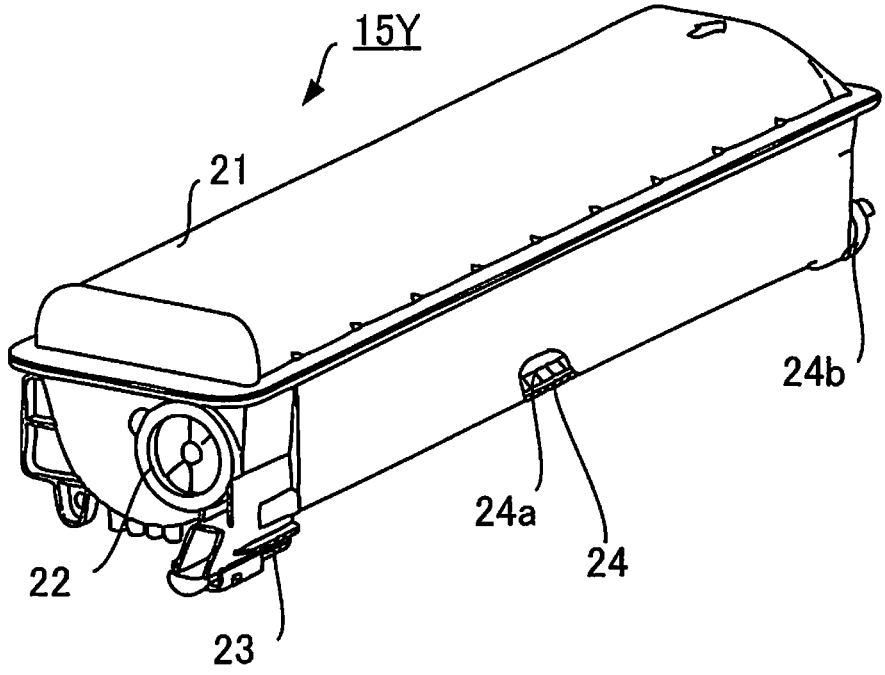
FIG. 2 is a perspective view of a toner cartridge in the embodiment viewed from the front.
Figure 3:
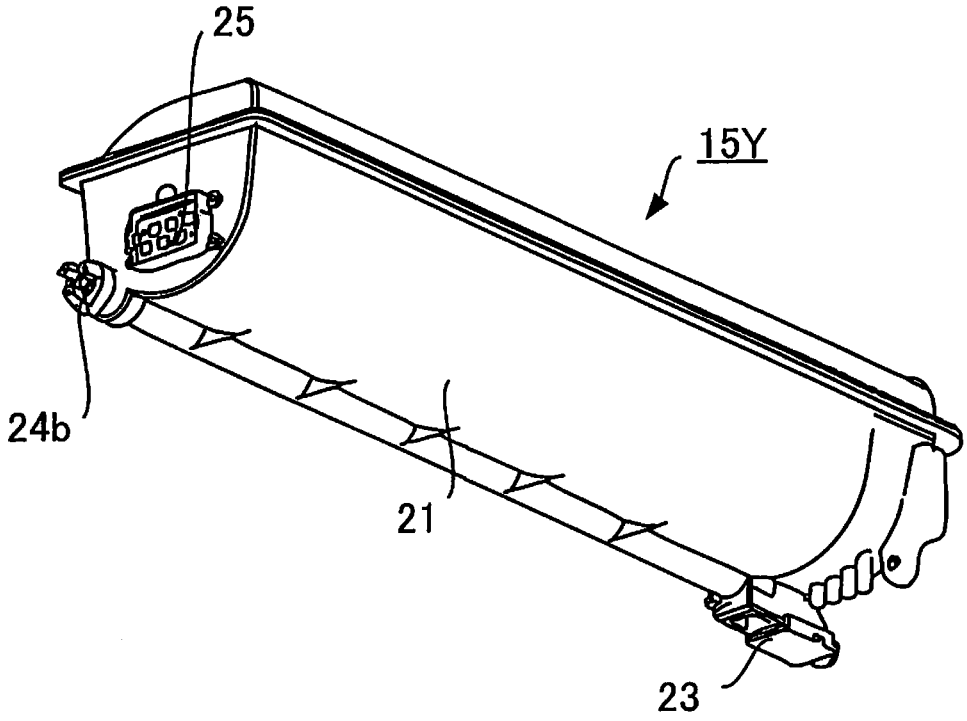
FIG. 3 is a perspective view of the toner cartridge viewed from the back.

The configuration of the first toner cartridge 15Y is explained below with reference to FIGS. 2 and 3. FIG. 2 is a perspective view of the toner cartridge 15Y viewed from the front of the apparatus. FIG. 3 is a perspective view of the toner cartridge 15Y viewed from the back of the apparatus. Since the configuration of the second to fourth toner cartridges 15M, 15C, and 15K is the same as that of the first toner cartridge 15Y, explanation of the configuration is omitted.

As shown in FIGS. 2 and 3, the toner cartridge 15Y includes a toner container 21, a toner filling section 22, a toner discharge section 23, an auger 24, and an IC unit 25 mounted with an IC chip as a storage section. For example, the IC chip includes a nonvolatile memory such as an EEPROM.

The toner container 21 is formed in a long cylindrical shape. A toner is filled on the inside of the toner container 21. The toner filling section 22 is a cap for filling the toner in the toner container 21 and is arranged in the front of the toner container 21. The toner discharge section 23 is a section for supplying the toner filled in the toner container 21 and is arranged at the front end of the toner container 21.

The auger 24 is arranged in a position corresponding to the toner discharge section 23 along the longitudinal direction of the toner container 21 on the inside of the toner container 21. A vane section 24*a* is spirally formed on the peripheral surface of the auger 24. When the auger 24 rotates, the toner filled in the toner container 21 is conveyed toward the toner discharge section 23 by the motion of the vane section 24*a*.

An end of the auger 24 is projected to the outside from a wall on the rear side of the toner container 21. The auger 24 has a coupling section 24*b* at the distal end thereof. The coupling section 24*b* fits with the toner motors arranged on the inside of the copying machine main body 10 and rotates the auger 24.

The IC unit 25 is a unit for storing printing management information such as a version, a lot number, specification identification, and a used amount of toner of the toner cartridge 15Y and is arranged at the rear end of the toner container 21.

Figure 4:
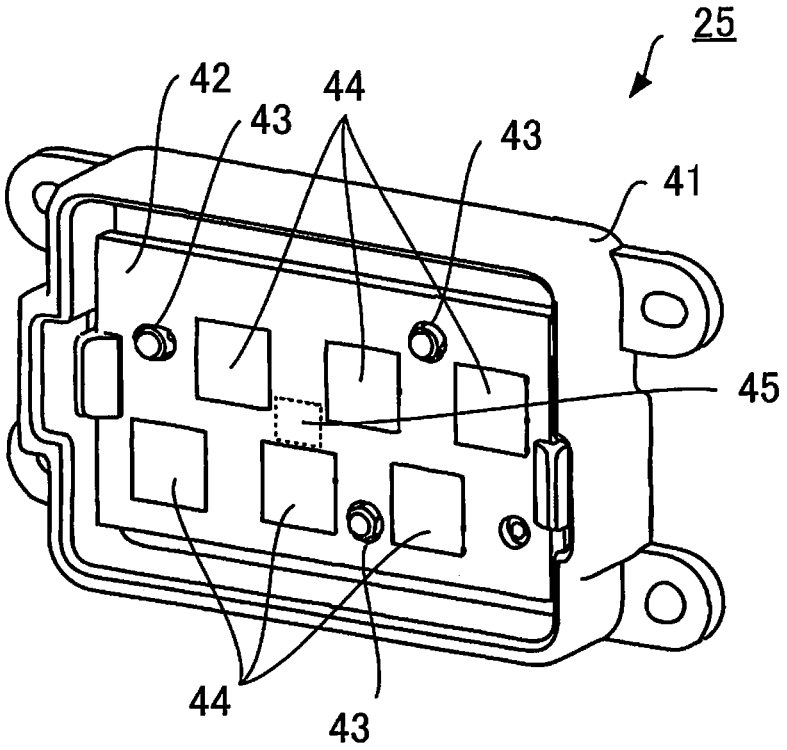
FIG. 4 is a perspective view of an IC unit in the toner cartridge.

FIG. 4 is a perspective view of the IC unit 25. As shown in FIG. 4, the IC unit 25 includes an IC-board attaching section 41 and an IC board 42. The IC board 42 is screwed to the IC-board attaching section 41 by plural screws 43.

An IC chip 45 is mounted on the IC board 42. The IC board 42 includes plural connection electrodes 44 connected to a main body of the image forming apparatus 1. When the toner cartridge 15Y is inserted into the cartridge holding mechanism 17 with the IC unit 25 first, spring contacts of the main body of the image forming apparatus 1 and connection electrode 44 are connected to enable readout of data from and writing of data in the IC chip 45. A necessary number of connection electrodes 44 are prepared, according to an IC chip in use, for an IC chip selection signal, a clock signal, write data, read data, an address signal, a power supply voltage, and a ground.

Figure 5:
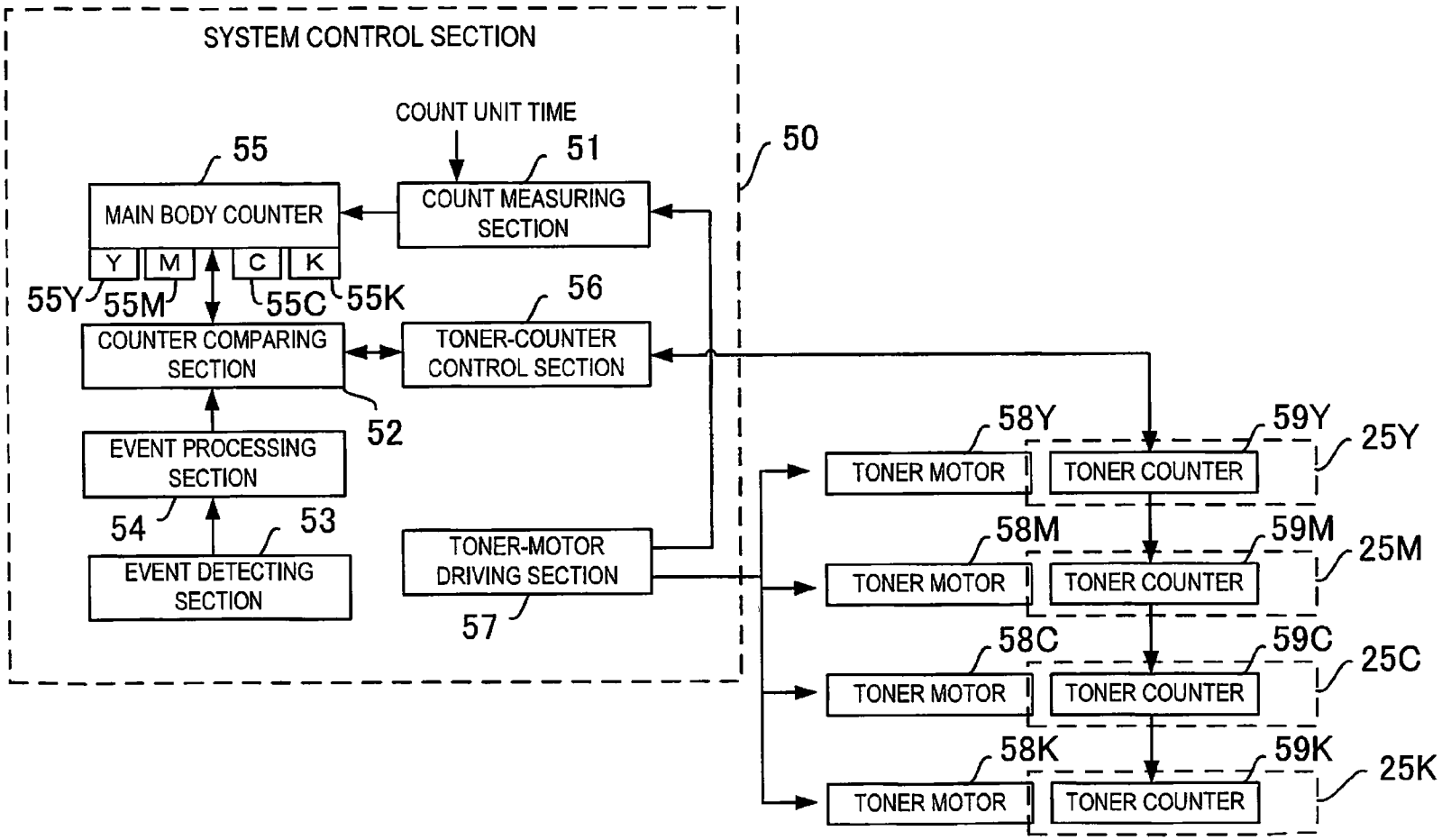
FIG. 5 is a block diagram of the image forming apparatus.

FIG. 5 is a block diagram of a system control section configured to collectively control the image forming apparatus 1. Blocks shown in FIG. 5 are only components indispensable for explaining this embodiment. A system control section 50 is arranged in the copying machine main body 10 and includes a count measuring section 51, a counter comparing section 52, an event detecting section 53, an event processing section 54, a main body counter 55, a toner-counter control section 56, and a toner-motor driving section 57. Further, toner motors 58Y, 58M, 58C, and 58K driven by the toner-motor driving section 57 are provided. Areas in which toner counter values are stored are provided in IC chips 45 mounted on toner cartridges. The areas are hereinafter referred to as toner counters 59Y, 59M, 59C, and 59K.

The toner-motor driving section 57 drives the toner motors 58Y, 58M, 58C, and 58K in order to supply toners to developing devices to supplement toners lost in copying and printing processes of the image forming apparatus 1.

The count measuring section 51 measures driving times of the toner motors 58Y, 58M, 58C, and 58K and calculates, with a predetermined driving time set as a basic unit (a count unit time), consumption count values indicating the consumptions of the toners. The driving unit as the basic unit of consumption count value measurement can be arbitrarily changed. In the following explanation of this embodiment, it is assumed that the driving time is, for example, 4 msec. As the consumption count value measurement, a driving time of a driving signal output from the toner-motor driving section 57 may be measured by a timer or the like.

The main body counter 55 adds the consumption count values measured for each of the toner motors 58Y, 58M, 58C, and 58K by the count measuring section 51 to current main body counter values, updates the current main body counter values, and stores the updated main body counter values. Main body counters for the respective colors are represented as 55Y, 55M, 55C, and 55K. As a memory in use, a memory having a limit in the number of times of writing such as an EEPROM is not used. A DRAM, an SRAM, or the like is used. The memory desirably includes an auxiliary battery or the like in order to store and keep main body counter values even when a power supply is turned off.

The event detecting section 53 detects operation events of the apparatus such as operation events (1) front cover close, (2) power on, (3) return from a sleep mode, (4) job execution, (5) end of a refresh mode, and (6) emergency stop.

The counter comparing section 52 compares the magnitudes of counter values stored in the main body counter 55 (55Y, 55M, 55C, and 55K) and the toner counters 59Y, 59M, 59C, and 59K of the IC chips. In comparing the counter values of the counters, the counter comparing section 52 compares the counter values for the respective colors. The counter comparison is used for determination of processing of the event processing section 54. This makes it possible to determine the consumptions of the toners, replacement of the toner cartridges, and the like.

The event processing section 54 performs processing for the operation events detected by the event detecting section 53. Depending on an operation event, the event processing section 54 performs the processing on the basis of the counter comparison.

Figure 6:
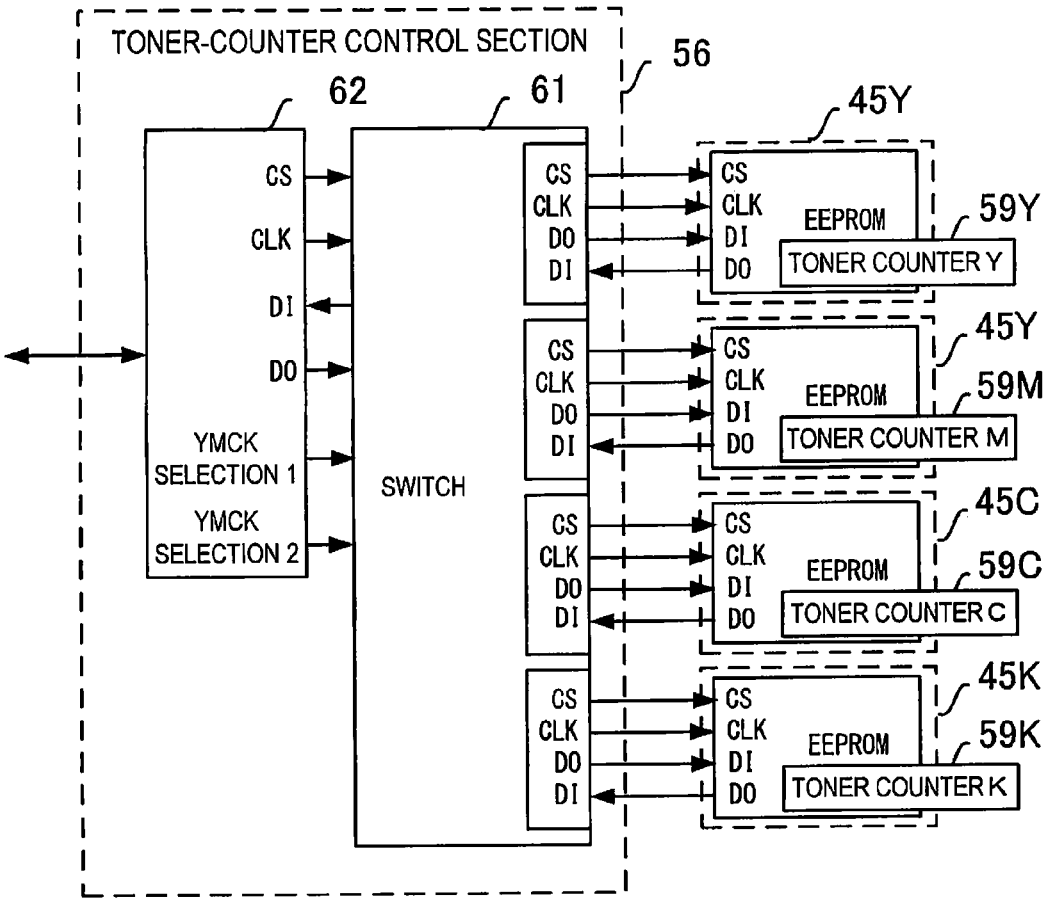
FIG. 6 is a block diagram of a toner-counter control section in the embodiment.

The toner-counter control section 56 writes counter values in and reads counter values from the toner counters 59Y, 59M, 59C, and 59K of the toner cartridges. For example, as shown in FIG. 6, the toner-counter control section 56 includes a selection switch 61 for selecting one of the toner counters 59Y, 59M, 59C, and 59K and a toner-counter selecting section 62 configured to receive a signal processed by the event processing section 54, sequentially select the toner counters, and perform reading and writing of counter values. The toner-counter selecting section 62 controls the selection switch 61 according to a two-bit selection signal for selecting one of IC chips 45Y, 45M, 45C, and 45K for the respective colors, a chip select signal CS for enabling the IC chips 45, a counter value reading signal DI, a counter value writing signal DO, and a clock signal CLK.

A table of operation events detected by the event detecting section 53 and processing performed by the event processing section 54 is shown in FIG. 7. As shown in FIG. 7, the event detecting section 53 detects operation events in states for S1: power on, S2: front cover close, S3: return from sleep, S4: job execution (S41: end of follow-up supply and S42: end of forced supply), S5: end of a refresh mode, S6: emergency stop (S61: front cover open and S62: power off), and S7: idling.

Basic processing of the events S1 to S3 is read processing for reading out counter values from the toner counters 59Y, 59M, 59C, and 59K. Thereafter, the read-out counter values of the toner counters 59Y, 59M, 59C, and 59K are respectively written in the main body counters 55Y, 55M, 55C, and 55K and matching of main body counter values and the toner counter values is performed.

Basic processing of the events S4 to S6 is write processing for counting up the main body counter values on the basis of consumption count values measured by the count measuring section 51 and writing counter values of the main body counters 55Y, 55M, 55C, and 55K in the toner counters 59Y, 59M, 59C, and 59K. In the event S7, processing for waiting for the events of S1 to S6 is performed.

Figure 8:
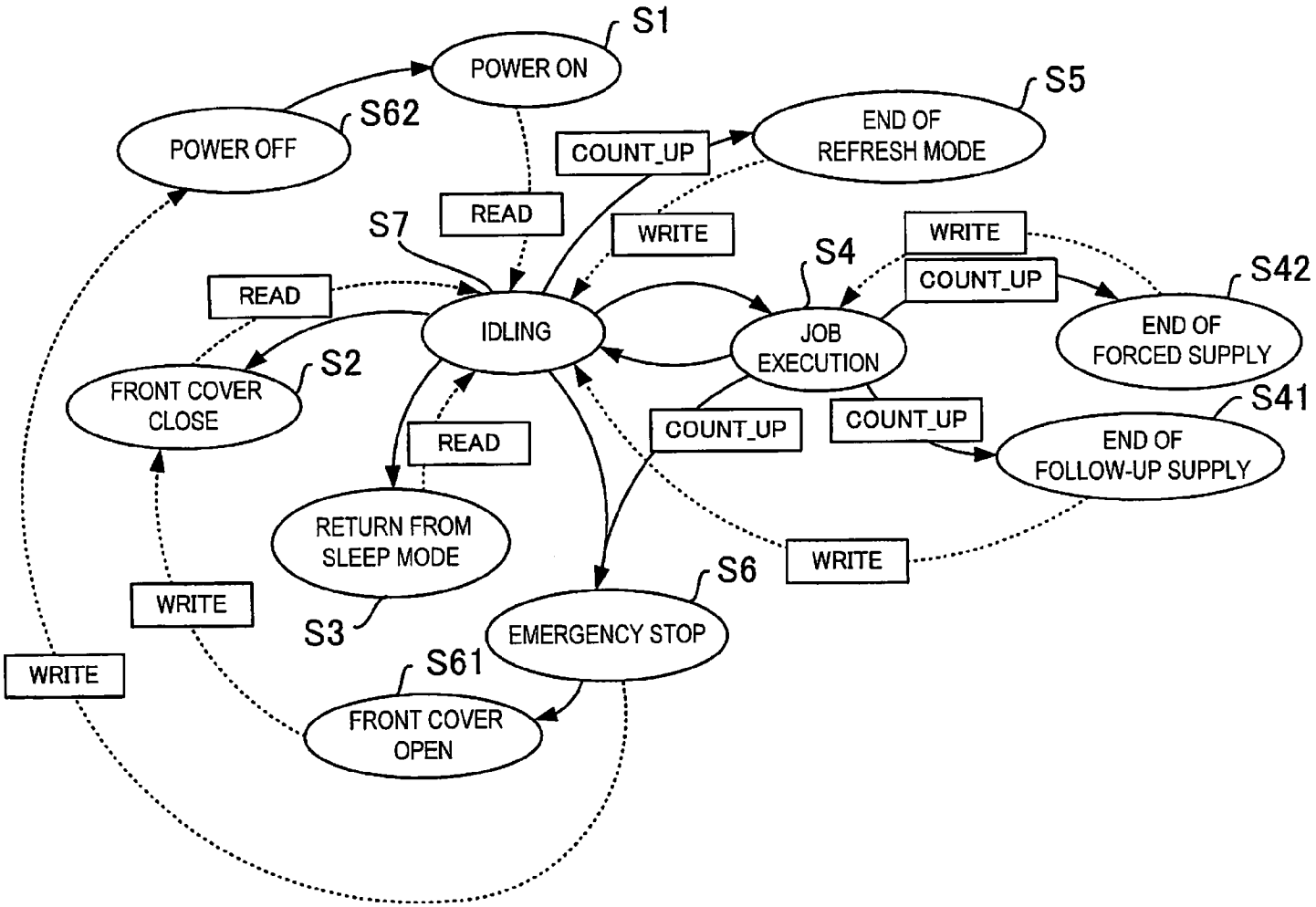
FIG. 8 is a diagram for explaining state transitions among the operation events and the processing.

State transitions among the events S1 to S6 and processing corresponding to the state transitions are explained with reference to FIG. 8. Ellipses represent states representing the operation events and squares represent the processing. State transitions indicated by solid line arrows represent state transitions in the image forming apparatus 1. State transitions indicated by broken line arrows include reading of counter values from and writing of counter values in the toner cartridges from the image forming apparatus 1.

First, in S1, a power supply is turned on. When the power supply is turned on, the image forming apparatus 1 reads toner counter values, updates main body counter values with the read-out toner counter values, transitions to the state for idling (S7), and waits for the other events S1 to S6 to occur.

When the front cover 14 is closed, the image forming apparatus 1 transitions from the state for idling (S7) to the state for front cover close (S2). When the front cover 14 is closed, this means that the front cover is open before being closed. It is likely that the toner cartridges 15Y, 15M, 15C, and 15K are replaced. Therefore, the image forming apparatus 1 applies the read processing for reading out counter values to the toner counters 59Y, 59M, 59C, and 59K, updates the main body counter values with the read-out toner counter values, and returns to the state for idling (S7).

When the image forming apparatus 1 returns from the sleep mode, the image forming apparatus 1 transitions from the state for idling (S7) to the state for return from the sleep mode (S3). The sleep mode is a power saving mode for hardly consuming electric power in the image forming apparatus 1 if no operation is performed for a fixed period. Therefore, during the sleep mode, only standby power necessary for returning to a normal mode is consumed. During the sleep mode, opening and closing of the front cover 14 cannot be detected. Therefore, it is likely that the toner cartridges 15Y, 15M, 15C, and 15K are replaced during the sleep mode. Therefore, the image forming apparatus 1 applies the read processing for reading out counter values to the toner counters 59Y, 59M, 59C, and 59K, updates the main body counter values with the read-out toner counter values, and returns to the state for idling (S7).

When copy printing is performed, the image forming apparatus 1 transitions from the state for idling (S7) to the state for job execution (S4). The state for job execution (S4) is further divided into a state for end of follow-up supply (S41) and a state for end of forced supply (S42). At this point, the image forming apparatus 1 transitions to the state for emergency stop (S6) as well.

The state for end of follow-up supply (S41) is a normal printing state in which, according to a print job, the toner motors 58Y, 58M, 58C, and 58K are driven to supply toners to be consumed. In this case, after performing count-up processing for updating the main body counter values on the basis of consumption count values measured by the count measuring section 51, the image forming apparatus 1 further performs write processing for writing counter values of the main body counters 55Y, 55M, 55C, and 55K in the toner counters 59Y, 59M, 59C, and 59K and returns to the state for idling (S7).

The state for end of forced supply (S42) is a state in which, when a print job having so large a toner consumption that the follow-up supply cannot meet is performed, printing is once stopped halfway in the job and supply of toners is forcibly performed. In this case, after performing count-up processing for updating the main body counter values on the basis of the consumption count values measured by the count measuring section 51, the image forming apparatus 1 further performs write processing for writing the counter values of the main body counters 55Y, 55M, 55C, and 55K in the toner counters 59Y, 59M, 59C, and 59K and once returns to the state for job execution (S4). If the forced supply is unnecessary for resumption of the remaining print job, the image forming apparatus 1 transitions to the state for end of follow-up supply (S41) and returns to the state for idling (S7) after the write processing.

The refresh mode (S5) is a mode for discharging old toners from the developing devices and injecting new toners into the developing devices in order to maintain printing quality when an image forming apparatus not in use for a long period is used. Therefore, during the refresh mode, the image forming apparatus 1 transitions from the state for idling (S7) to the state for end of the refresh mode (S5). In this case, as in the case explained above, after the count-up processing, the image forming apparatus 1 performs the write processing for writing the updated counter values of the main body counters 55Y, 55M, 55C, and 55K in the toner counters 59Y, 59M, 59C, and 59K and returns to the state for idling (S7).

If a job is urgently stopped during the copy printing, after once returning to the state for job execution (S4) or the state for idling (S7), the image forming apparatus 1 transitions to the state for emergency stop (S6). The state for emergency stop (S6) is further divided into a state for front cover open (S61) and a state for power off (S62).

The state for front cover open (S61) is a state in which the front cover is opened and maintenance work is performed if toners are insufficient and printing quality cannot be maintained during printing or a paper jam or the like occurs. In this case, as in the case explained above, after performing the count-up processing, the image forming apparatus 1 performs the write processing for writing the updated counter values of the main body counters 55Y, 55M, 55C, and 55K in the toner counters 59Y, 59M, 59C, and 59K and returns to the state for front cover close (S2).

The state for power off (S62) is a state in which an operator presses a power-off button in order to stop a print job. In this case, as in the case explained above, after performing the count-up processing, the image forming apparatus 1 performs the write processing for writing the updated counter values of the main body counters 55Y, 55M, 55C, and 55K in the toner counters 59Y, 59M, 59C, and 59K and waits for transition to the state for power on (S1). In the state for power off (S62), the power supply is interrupted after the processing explained above ends.

Figure 9:
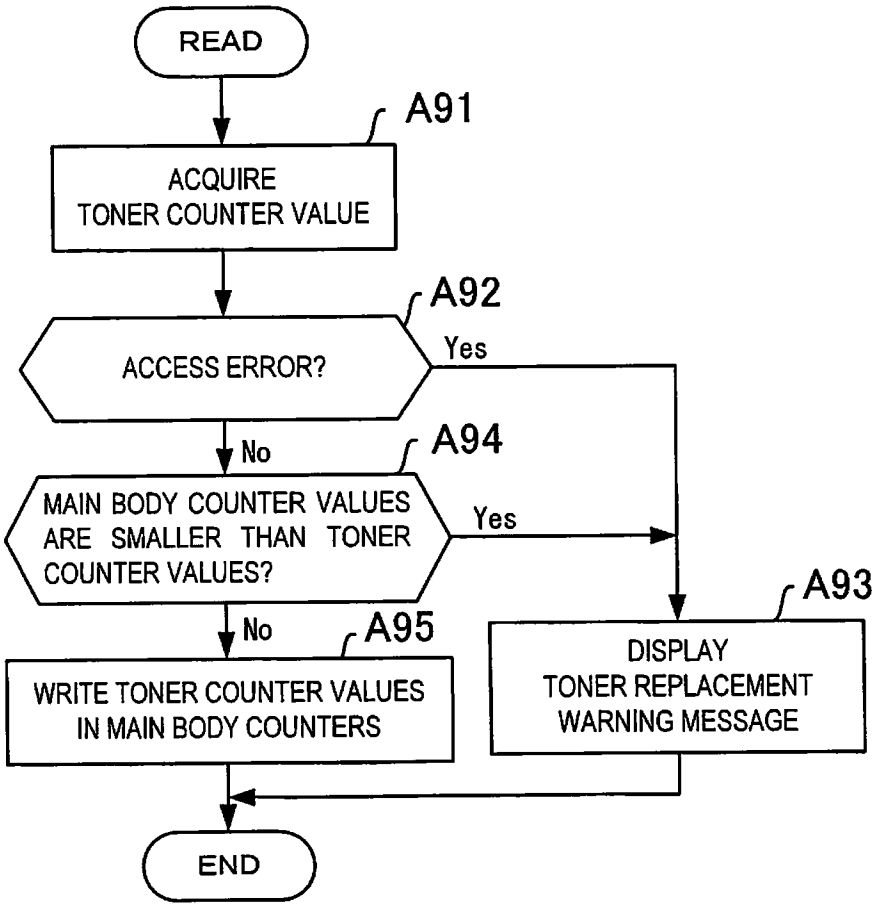
FIG. 9 is a flowchart for explaining read processing for reading a counter value from a toner counter in the embodiment.

The read processing is explained with reference to FIG. 9. In Act A91, the image forming apparatus 1 accesses the toner counters 59Y, 59M, 59C, and 59K and acquires toner counter values. If an error of access to the toner counters 59Y, 59M, 59C, and 59K occurs in Act 92 (Yes in Act A92), the image forming apparatus 1 determines that the IC chips 45 are broken and displays, on the control panel 12, a message indicating that it is necessary to replace toner cartridges (Act A93). In Act A94, the image forming apparatus 1 compares, for the respective colors, the magnitudes of the counter values of the main body counters 55Y, 55M, 55C, and 55K and the toner counters 59Y, 59M, 59C, and 59K. If the main body counter values are smaller than the toner counter values (Yes in Act A94), the image forming apparatus 1 displays, on the control panel 12, a message indicating that the toner cartridges are likely to be replaced with old toner cartridges (Act A93). If the main body counter values are larger than or equal to the toner counter values (No in Act A94), the image forming apparatus 1 writes the toner counter values in the main body counters (Act A95).

Figure 10:
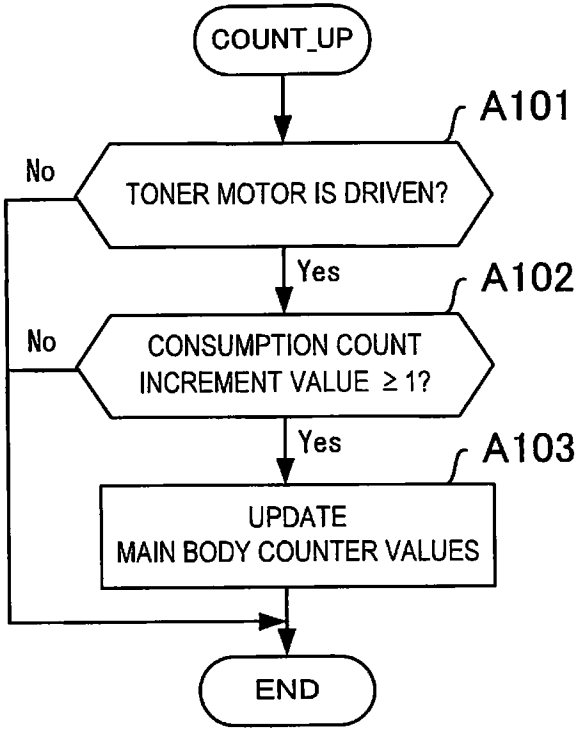
FIG. 10 is a flowchart for explaining count-up processing of the toner counter.

The count-up processing is explained below with reference to FIG. 10. If the toner motors 58Y, 58M, 58C, and 58K are driven in Act A101, the image forming apparatus 1 measures driving times of the toner motors 58Y, 58M, 58C, and 58K using a timer or the like and measures consumption count values with, for example, a count unit time 4 msec set as a basic unit. If an increment value of the consumption count values is equal to or larger than one (Yes in Act A102), the image forming apparatus 1 adds the consumption count values to the main body counter values and updates the main body counter values (Act A103).

Figure 11:
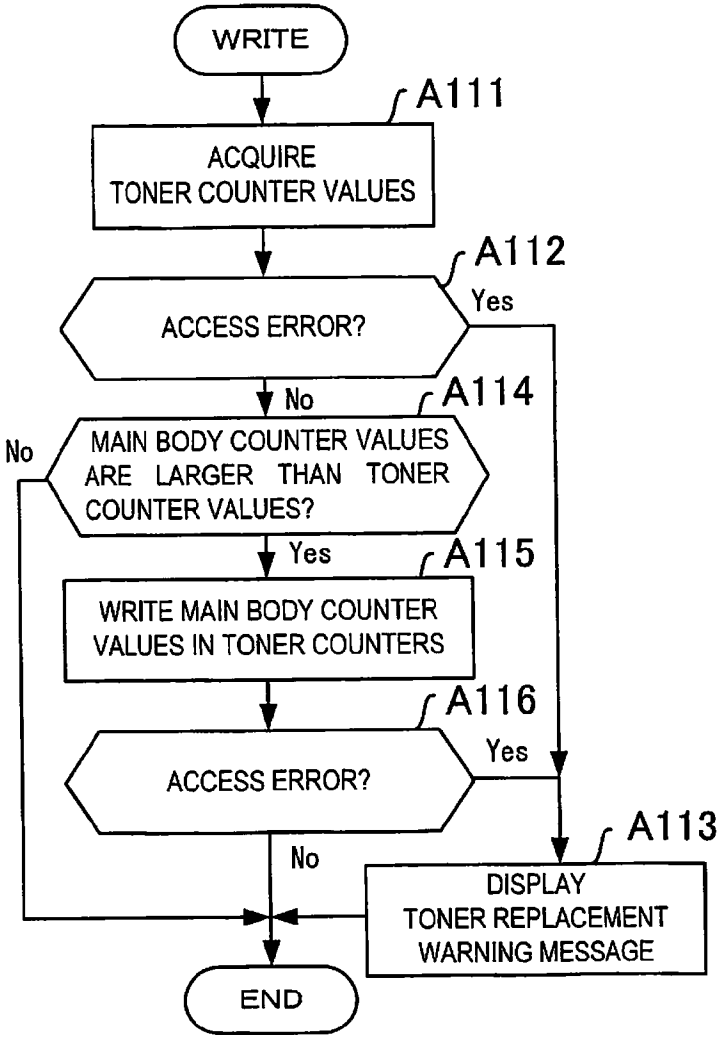
FIG. 11 is a flowchart for explaining write processing for writing a counter value in the toner counter.

The write processing is explained below with reference to FIG. 11. In Act A111, the image forming apparatus 1 accesses the toner counters 59Y, 59M, 59C, and 59K and acquires toner counter values. If an error of access to the toner counters 59Y, 59M, 59C, and 59K occurs in Act A112 (Yes in Act A112), the image forming apparatus 1 determines that the IC chips 45 are broken and displays, on the control panel 12, a message indicating that it is necessary to replace the toner cartridges (Act A113). In Act A114, the image forming apparatus 1 compares, for the respective colors, the magnitudes of the counter values of the main body counters 55Y, 55M, 55C, and 55K and the toner counters 59Y, 59M, 59C, and 59K (Act A114). Concerning the toner cartridges in which the main body counter values are larger than the toner counter values (Yes in Act A114), the image forming apparatus 1 determines that the toners are consumed and writes the main body counter values in the toner counters (Act 115). Concerning the toner cartridges in which the main body counter values are smaller than or equal to the toner counter values (No in Act 114), the image forming apparatus 1 determines that the toners are not consumed, proceeds to END, and does not perform writing. In Act A116, the image forming apparatus 1 determines whether writing in the IC chips 45 is successful. If an access error occurs (Yes in A116), the image forming apparatus 1 determines that the IC chips 45 are broken and displays, on the control panel 12, a message indicating that it is necessary to replace the toner cartridges (Act A113). If an access error does not occur (No in A116), the image forming apparatus 1 normally ends the processing.

As explained above, according to the first embodiment, it is possible to access the IC chips of the toner cartridges for a set event and match the toner counter values and the main body counter values. The counter values are written in the IC chips only during an operation event for performing writing. Therefore, it is possible to substantially reduce the number of times of writing compared with that in the past.

When the toner counter values are written in the IC chips 45, the toner counter values and the main body counter values are compared and writing is performed only in the toner cartridges in which the toners are consumed. Therefore, it is possible to further reduce the number of times of writing.

Further, even if the toner cartridges are replaced in maintenance or the like, it is possible to correctly match the main body counter values and the toner counter values.

Second Embodiment

In the first embodiment, the image forming apparatus 1 accesses the toner cartridges and acquires toner counter values. In a second embodiment, the image forming apparatus 1 stores copies of toner counter values of the toner cartridges in a main body area separate from the main body counters to realize an increase in speed and simplification of read processing and write processing.

Figure 12:
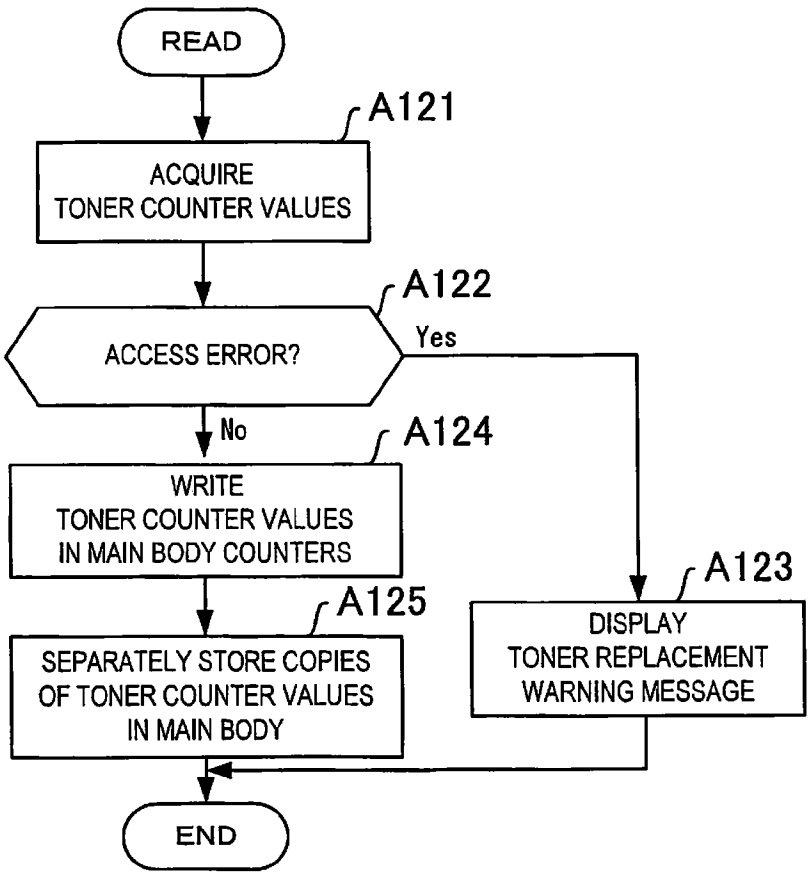
FIG. 12 is a flowchart for explaining read processing of a toner counter in a second embodiment.

The read processing in this embodiment shown in FIG. 12 is explained. In Act A121, the image forming apparatus 1 accesses the toner counters 59Y, 59M, 59C, and 59K and acquires toner counter values. If an error of access to the toner counters 59Y, 59M, 59C, and 59K occurs in Act A122 (Yes in Act A122), the image forming apparatus 1 determines that the IC chips 45 are broken and displays, on the control panel 12, a message indicating that it is necessary to replace the toner cartridges (Act A123). If an error of access to the toner counters 59Y, 59M, 59C, and 59K does not occur (No in Act A122), in Act A124, the image forming apparatus 1 writes the toner counter values in the main body counters. The image forming apparatus 1 stores copies of the toner counter values in a main body area separate from the main body counters (Act A125).

Figure 13:
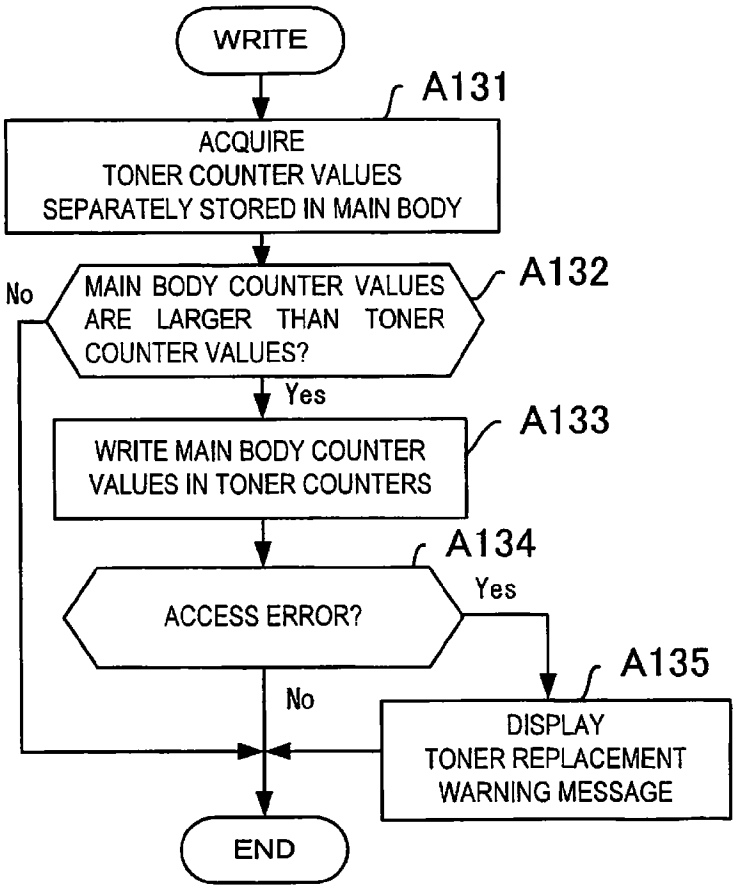
FIG. 13 is a flowchart for explaining write processing of the toner counter.

The write processing is explained below with reference to FIG. 13. In Act A131, the image forming apparatus 1 acquires the toner counter values separately stored in the main body of the image forming apparatus 1. In Act A132, the image forming apparatus 1 compares, for the respective colors, the magnitudes of the counter values of the main body counters 55Y, 55M, 55C, and 55K and the toner counters 59Y, 59M, 59C, and 59K. Concerning the toner cartridges in which the main body counter values are larger than the toner counter values (Yes in Act A132), the image forming apparatus 1 determines that the toners are consumed and writes the main body counter values in the toner counters (Act A133). Concerning the toner cartridges in which the main body counter values are smaller than or equal to the toner counter values (No in Act A132), the image forming apparatus 1 determines that the toners are not consumed, proceeds to END, and does not perform writing. In Act A134, the image forming apparatus 1 determines whether writing in the IC chips 45 is successful. If an access error occurs (Yes in A134), the image forming apparatus 1 determines that the IC chips 45 are broken and displays, on the control panel 12, a message indicating that it is necessary to replace the toner cartridges (Act A135). If an access error does not occur (No in A134), the image forming apparatus 1 normally ends the processing.

As explained above, according to the second embodiment, in addition to the effects of the first embodiment, an increase in speed and simplification of the read processing and the write processing are attained because it is unnecessary to access the toner cartridges to read counter values.

Third Embodiment

In a third embodiment, an embodiment enabling further simplification of read processing and write processing is explained.

Figure 14:
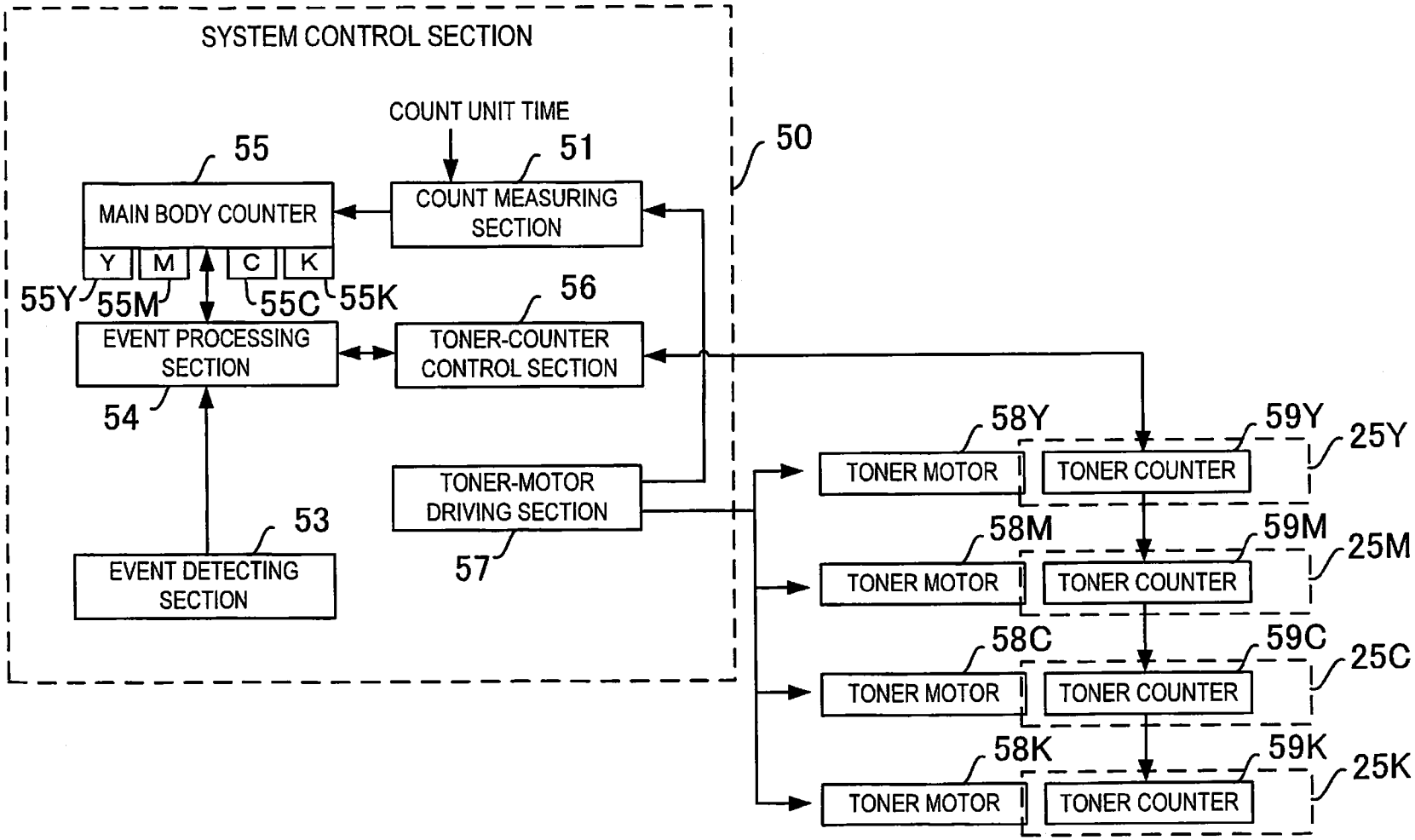
FIG. 14 is a block diagram of an image forming apparatus according to a third embodiment.

FIG. 14 is a block diagram of a system control section configured to collectively control the image forming apparatus 1. Blocks shown in FIG. 14 are only components indispensable for explaining this embodiment. A system control section 50 in this embodiment includes the count measuring section 51, the event detecting section 53, the event processing section 54, the main body counter 55, the toner-counter control section 56, and the toner-motor driving section 57. Compared with FIG. 5, the counter-value comparing section 52 is omitted.

Figure 15:
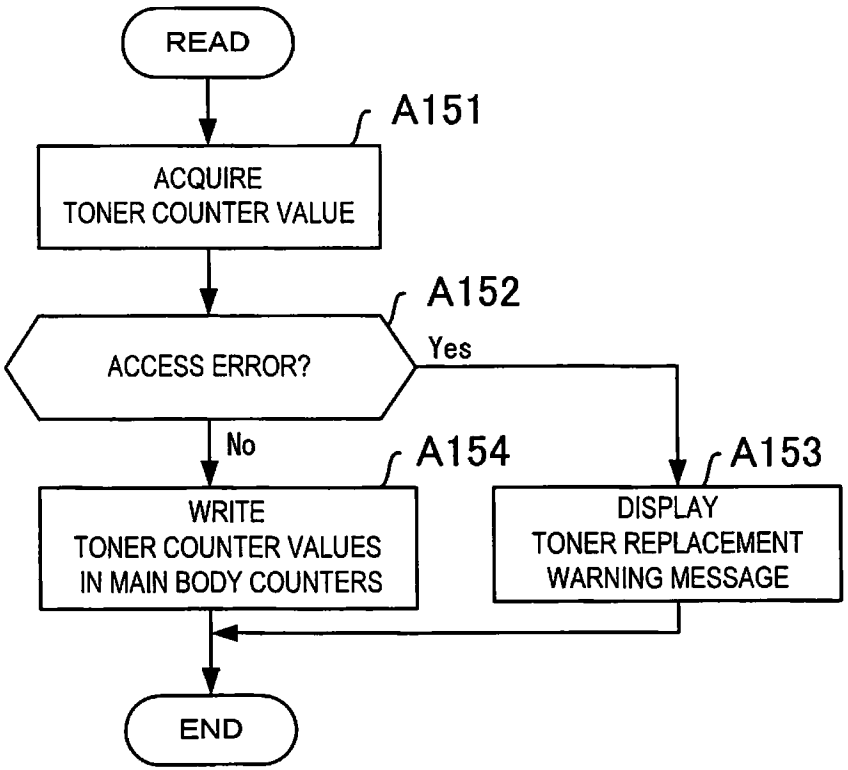
FIG. 15 is a flowchart for explaining read processing of a toner counter in the embodiment.
Figure 16:
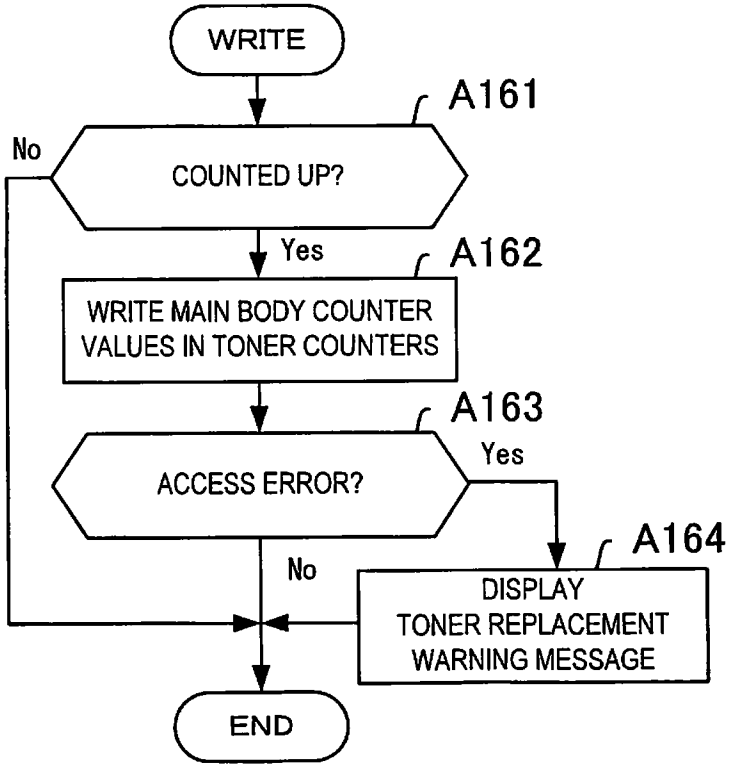
FIG. 16 is a flowchart for explaining write processing of the toner counter.

The counter comparing section 52 in the first embodiment detects the consumptions of the toners by comparing the main body counter values and the toner counter values. However, if only toner consumption detection is performed, the count measuring section 51 only has to detect whether counter values are counted up. A flowchart of the read processing in this embodiment is shown in FIG. 15. A flowchart of the write processing in this embodiment is shown in FIG. 16. As shown in FIG. 15, in the read processing, first, in Act A151, the image forming apparatus 1 accesses the toner counters 59Y, 59M, 59C, and 59K and acquires counter values of the toner counters. If an error of access to the toner counters 59Y, 59M, 59C, and 59K occurs in Act A152 (Yes in Act A152), the image forming apparatus 1 determines that the IC chips 45 are broken and displays, on the control panel 12, a message indicating that it is necessary to replace the toner cartridges (Act A153). If an access error does not occur (No in A152), the image forming apparatus 1 writes the toner counter values in the main body counters (Act A154) and normally ends the processing.

In the write processing shown in FIG. 16, first in Act A161, the image forming apparatus 1 determines whether the count measuring section 51 counts up counter values. If the counter values are counted up (Yes in Act A161), the image forming apparatus 1 determines that toners are consumed and writes the main body counter values in only the toner cartridges in which the counter values are counted up (Act A162). If the counter values are not counted up (No in Act A161), the image forming apparatus 1 determines that toners of the toner cartridges are not consumed, proceeds to END, and does not perform writing.

In Act A163, the image forming apparatus 1 determines whether the writing in the IC chips 45 is successful. If an access error occurs (Yes in A163), the image forming apparatus 1 determines that the IC chips 45 are broken and displays, on the control panel 12, a message indicating that it is necessary to replace the toner cartridges (Act 164). If an access error does not occur (No in A163), the image forming apparatus 1 normally ends the processing.

As explained above, according to the third embodiment, in addition to the effects of the first and second embodiments, the configuration is simplified and an increase in speed and simplification of the read processing and the write processing are attained because the main body counter values and the toner counter values are not directly compared.

As explained above, according to the embodiments, it is possible to access the IC chips of the toner cartridges for a set operation event and match toner counter values and main body counter values. It is possible to substantially reduce the number of times of writing compared with that in the past because counter values are written in the IC chips only during an operation event for performing writing.

When toner counter values are written in the IC chips, the toner counter values and the main body counter values are compared and counter values are written in only the toner cartridges in which toners are consumed. Therefore, it is possible to further reduce the number of times of writing.

Further, it is possible to correctly match the main body counter values and the toner counter values even if the cartridges are replaced in maintenance or the like.

In the embodiments, the message for toner cartridge replacement is described. However, a different message maybe displayed for each of operation events, for example, a message is issued during emergency stop.

While certain embodiments have been described, these embodiments have been presented by way of example only, and are not intended to limit the scope of the inventions. Indeed, the novel embodiments described herein maybe embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a toner cartridge which includes a storage section;

a toner motor configured to drive agitation of toner in the toner cartridge;

a toner-motor driving section configured to drive the toner motor;

a count measuring section configured to measure a driving time of the toner motor and calculate a consumption count value indicating a consumption of the toner;

an event detecting section configured to detect an operation event;

a main body counter configured to update a main body counter value with the consumption count value and store the main body counter value;

a toner counter configured to store a toner counter value in the storage section; and an event processing section configured to perform a write processing including writing the main body counter value as the toner counter value stored in the storage section if the operation event detected by the event detecting section is a power off indicating event.

2. The apparatus according to claim 1, wherein the event processing section is further configured to perform a count-up processing including updating the main body counter value on the basis of an increment of the consumption count value measured by the count measuring section before the write processing.

3. The apparatus according to claim 1, wherein the storage section includes a nonvolatile memory.

4. The apparatus according to claim 3, wherein the toner counter value is stored in an area separate from the main body counter.

5. The apparatus according to claim 4, wherein the main body counter includes an SRAM or a DRAM, and includes an auxiliary battery.

6. A control method for an image forming apparatus comprising:

driving, with a toner motor, agitation of toner in a toner cartridge which includes a storage section;

measuring a driving time of the toner motor;

calculating a consumption count value indicating a consumption of the toner;

detecting an operation event;

updating a main body counter value with the consumption count value and storing the main body counter value in a main body counter;

storing a toner counter value in a toner counter in the storage section; and when the operation event detected by the event detecting section is a power off indicating event, performing a write processing including writing the main body counter value as the toner counter value in the storage section.

7. The method according to claim 6, further performing a count-up processing including updating the main body counter values on the basis of an increment of the consumption count value measured by the count measuring section before the write processing.

* * * * *